US006868938B2

(12) United States Patent
Lecours

(10) Patent No.: US 6,868,938 B2
(45) Date of Patent: Mar. 22, 2005

(54) NOISE-REDUCING ENGINE ENCLOSURE

(75) Inventor: Gaetan Lecours, Valcourt (CA)

(73) Assignee: Bombardier Recreational Products Inc., Valcourt (CA)

( * ) Notice: Subject to any disclaimer, the term of this patent is extended or adjusted under 35 U.S.C. 154(b) by 86 days.

(21) Appl. No.: 10/237,087

(22) Filed: Sep. 9, 2002

(65) Prior Publication Data

US 2003/0047379 A1 Mar. 13, 2003

Related U.S. Application Data

(60) Provisional application No. 60/317,509, filed on Sep. 7, 2001.

(51) Int. Cl.[7] ..... F01N 3/02; F01N 3/06

(52) U.S. Cl. ..... 181/231; 181/234

(58) Field of Search ..... 181/231, 212, 181/211, 224–230, 232, 234, 235

(56) References Cited

U.S. PATENT DOCUMENTS 5,009,043 A * 4/1991 Kurrasch ..... 52/145
5,390,621 A 2/1995 Hattori et al.
5,467,747 A * 11/1995 Brandt et al. ..... 123/198 E
5,586,922 A 12/1996 Kobayashi et al.
5,743,206 A 4/1998 Hattori
5,957,022 A 9/1999 Stumpf et al.
6,033,756 A * 3/2000 Handscomb ..... 428/138
6,471,557 B1 10/2002 Hattori

* cited by examiner

*Primary Examiner*—Kimberly Lockett
(74) *Attorney, Agent, or Firm*—BRP Legal Services

(57) ABSTRACT

A noise-reducing engine enclosure for an engine includes first and second members removably mounted to one another in cooperating relation to define an engine receiving space therebetween. The first and second members each include a noise-reducing layer of material to reduce noise transmission to the atmosphere outside of the engine enclosure during operation. The first and second members are movable between (1) an engine accessing position, wherein the first and second members are positioned to allow access to the engine during operation and (2) an engine enclosing position, wherein the first and second members cooperate to define the engine receiving space to receive and enclose the engine therein such that noise transmission to the atmosphere during operation is reduced.

46 Claims, 11 Drawing Sheets

NOISE-REDUCING ENGINE ENCLOSURE

This application claims priority to U.S. Provisional Patent Application Ser. No. 60/317,509, filed Sep. 7, 2001, the entirety of which is hereby incorporated by reference.

BACKGROUND OF THE INVENTION

1. Field of the Invention

The present invention relates to a noise-reducing engine enclosure. More specifically, the present invention relates to a noise-reducing engine enclosure for a vehicle engine, such as a personal watercraft engine or other motor vehicle engine.

2. Description of Background Information

Often, vehicles including engines, such as internal combustion engines, and their accessories, e.g., an engine-driven cooling fan or an air intake system, can emit noise during operation.

Recent interest in various approaches for reducing noise emanating from engines and their accessories of vehicles, such as personal watercraft, has developed. This is due to interest by several countries, such as the United States and France, which are studying the possibility of passing noise regulations which will limit the allowed noise that can be emitted from such vehicles.

Consequently, there is a need in the industry to develop ways for reducing noise emitted from an engine and its accessories as implemented in a vehicle, such as a personal watercraft, snowmobile, or other motorized vehicle.

SUMMARY OF THE INVENTION

To address the above-identified need and to overcome the drawbacks of noise caused by engines and their accessories, embodiments of the present invention provide a noise-reducing enclosure for receiving an engine.

According to one aspect of the present invention, the noise-reducing engine enclosure includes a first member and a second member. The first member and the second member are positioned in cooperating relation with respect to each other to define an engine receiving space between the first and second members. The engine receiving space is configured to receive and enclose the engine therein. The first and second members each include a noise-reducing layer of material that is constructed and arranged to reduce noise transmission to the atmosphere external of the engine receiving space during operation of the engine. The first and second members provide at least one opening configured either to allow air to be communicated to the engine and/or to enable functional components external to the enclosure to be operatively connected to the engine. The first member is movable with respect to the second member between (1) an engine accessing position, wherein the first and second members are positioned to allow access to the engine during operation thereof and (2) an engine enclosing position, wherein the first and second members cooperate to define the engine receiving space to receive and enclose the engine therein such that noise transmission to the atmosphere from the enclosure during operation of the engine is reduced.

The noise-reducing engine enclosure can be formed of multiple layers of material, which can be of various thicknesses if desired. The first and second members may be interference fit together or sealed with gaskets.

The noise-reducing engine enclosure can be removably coupled to the hull. Alternatively, one or more components of the engine enclosure can be formed as part of the hull.

Further, the noise-reducing engine enclosure can be spaced from the hull with the engine support extending through the enclosure.

Another aspect of the present invention provides a noise-reducing engine enclosure for surrounding an engine to reduce noise transmission from the engine to an atmosphere external of the noise-reducing enclosure. The noise-reducing enclosure comprises a first member having a first engine surrounding wall and a second member having a second engine surrounding wall. The first and second engine surrounding walls each include a noise-reducing layer of material and are engageable in cooperating relation with one another to define an engine receiving space therebetween in which noise transmission to the atmosphere during operation is reduced by the noise-reducing layer of material. The first and second members provide at least one opening, which is configured either to allow air to be communicated to the engine receiving space or to enable functional components external to the enclosure to be operatively connected to the engine.

Another aspect of the present invention is to provide a personal watercraft that includes a hull, an engine, a propulsion system, and a noise-reducing engine enclosure. The engine is constructed and arranged to generate power and is supported by the hull. The propulsion system is connected to the engine and is constructed and arranged to propel the watercraft along a surface of a body of water using the power generated by the engine. The engine can be either an internal combustion engine or an electric engine, for example. The noise-reducing engine enclosure is supported by the hull and surrounds the engine.

A further aspect of the invention is to provide a snowmobile including a noise-reducing engine enclosure.

These and other aspects and features of this invention will be described in or be apparent from the following detailed description when taken in conjunction with the accompanying drawings, which are a part of this disclosure and which illustrate, by way of example, preferred embodiments of the invention.

BRIEF DESCRIPTION OF THE DRAWINGS

The accompanying drawings facilitate an understanding of the various embodiments of this invention. In the drawings.

DETAILED DESCRIPTION OF PREFERRED EMBODIMENTS OF THE INVENTION

Figure 1:
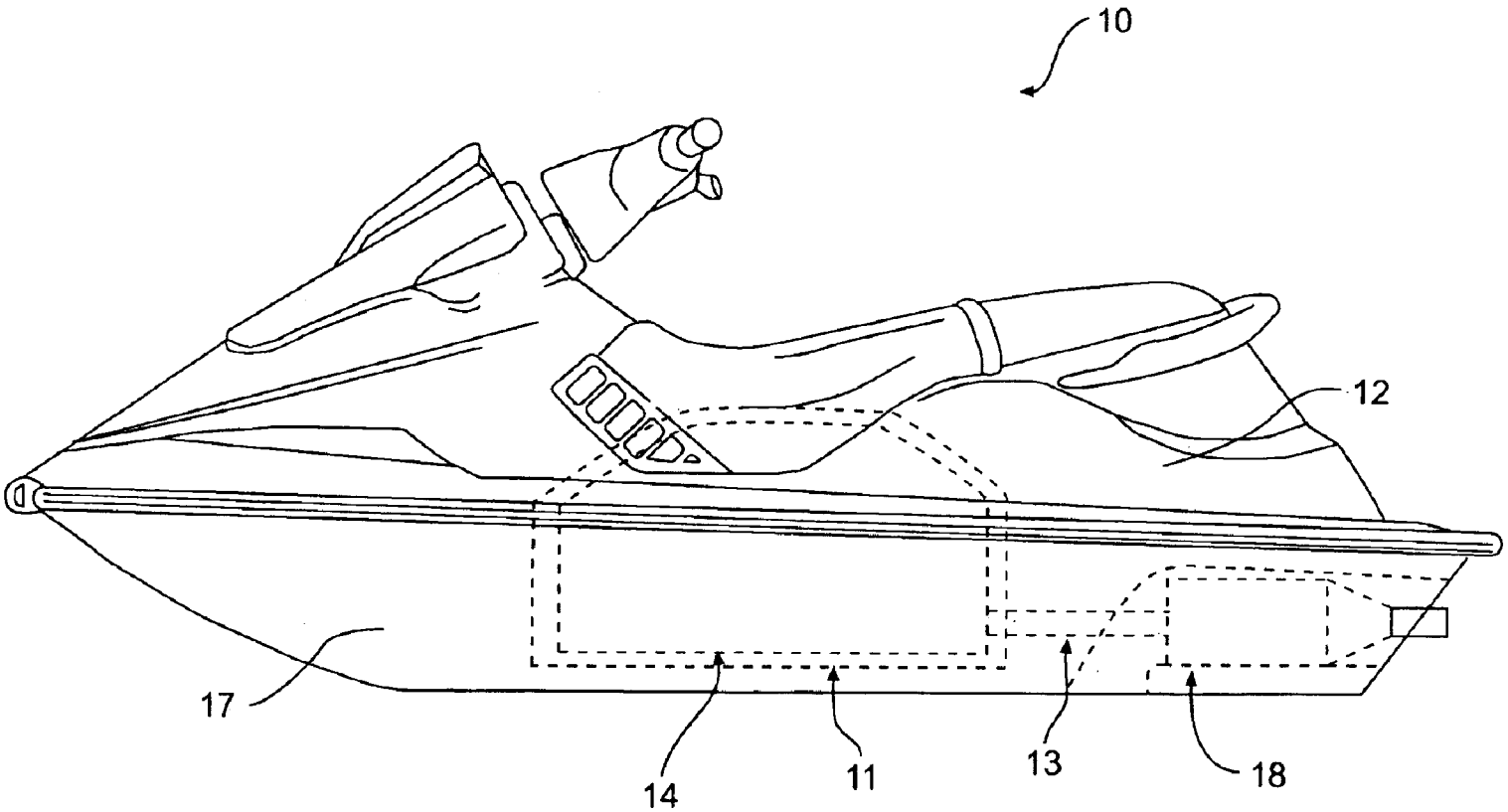
FIG. 1 is a side view showing a vehicle, for example, a personal watercraft, including a noise-reducing engine enclosure constructed according to the principles of the present invention.
Figure 7:
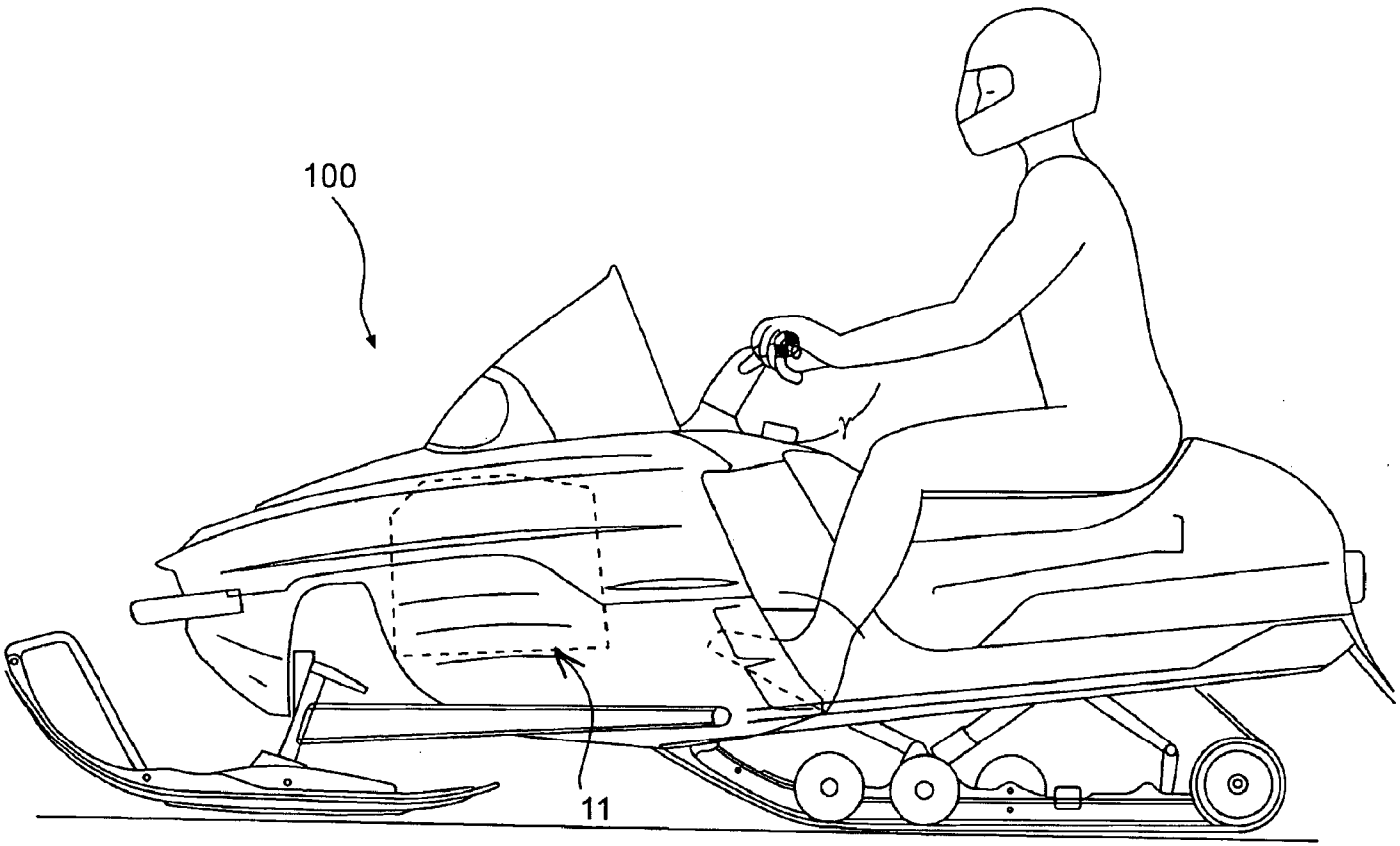
FIG. 7 is a side view of another alternative noise-reducing engine enclosure according to the principles of the present invention, showing the noise-reducing engine enclosure releasably mounted within a vehicle, which, in this case, is a snowmobile.

FIG. 1 shows a vehicle, generally indicated at 10, that includes a noise-reducing engine enclosure, generally indicated at 11, according to the principles of the present invention. The engine enclosure 11 is shown in use in a personal watercraft for purposes of illustration only and is not intended to be limiting. The engine enclosure 11 may be used in conjunction with various types of vehicles, especially recreational vehicles, including, for example, snowmobiles as seen in FIG. 7.

As illustrated, the vehicle 10 is a personal watercraft that is designed for traveling along a surface of a body of water. The vehicle 10 comprises a hull 17 for buoyantly supporting the vehicle 10 on the surface of the body of water. The hull 17 is typically molded from fiberglass material and partially lined internally with buoyant foam material.

Figure 3:
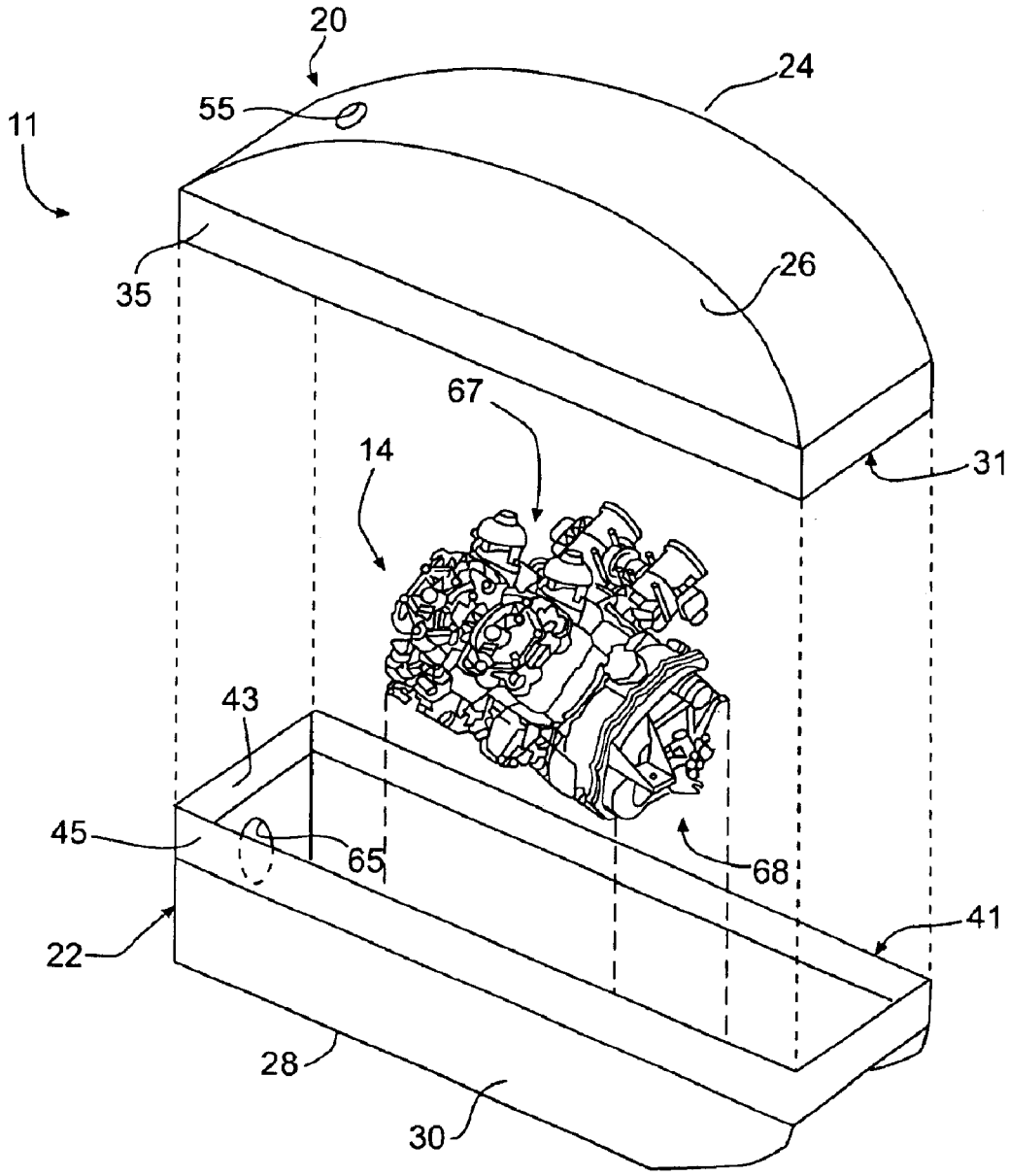
FIG. 3 is a perspective view of the noise-reducing engine enclosure shown in FIG. 2, illustrating an engine disposed between the upper and lower portions of the noise-reducing engine enclosure.

An engine, such as an internal combustion engine or electric engine, is generally shown at 14 in FIG. 3. The engine 14 is carried by and within the noise-reducing engine enclosure 11. The noise-reducing engine enclosure 11 is fixedly disposed within a cavity formed between a deck 12 and the hull 17. For example, the noise-reducing engine enclosure 11 can tightly abut the interior surfaces of the deck cavity or may be coupled to hull 17 with fasteners, such as screws, nuts and bolts, or clamps. Dampening material can be added to provide a more secure fit, if necessary, and to reduce vibrations. The noise-reducing engine enclosure 11 may be constructed to substantially conform to the configuration of the cavity formed between the deck 12 and the hull 17. Further, the engine enclosure 11 may be formed as portions of the hull or vehicle structure.

As is well known in the art (and therefore not shown), the engine 14 includes a crankcase and forms a crankcase chamber in which a crankshaft is rotatably journaled. A plurality of reciprocating pistons (not shown) is connected to the crankshaft. The reciprocating motion of the pistons is translated into rotary motion of the crankshaft in a well-known manner. Specifically, the pistons reciprocate within a plurality of cylinders through a four or two stroke combustion cycle. A mixture of air and fuel in a four-stroke engine, or air, fuel and oil in a two-stroke engine, are combusted sequentially within the cylinders to drive the pistons and generate rotational movement of the crankshaft. The engine 14 has an air intake for receiving air to be mixed with the fuel supplied to the engine 14. The engine 14 may be of any construction. Alternatively, the engine may be electric.

A propulsion system, generally shown at 18 in FIG. 1, is connected to the crankshaft of the engine 14 in the hull's stem portion. The propulsion system 18 typically includes a propelling element or structure, such as a propeller or impeller, connected to one end of a driveshaft 13, with the other end of the driveshaft 13 being coupled to the crankshaft so that powered rotation of the crankshaft rotates the propelling structure via the driveshaft 13. The propelling structure displaces water during rotation thereof so as to propel the vehicle 10 along the surface of the body of water. The propulsion system 18 may be centrally positioned within the hull 12 and may have any construction. The specific design is not vital to the present invention, although it will commonly be of the water jet type.

As is well known in the art and therefore not shown, the deck 12 has a plurality of vent openings that enable ambient air to enter the deck 12 for consumption by the engine 14 during combustion. Vent hoses connect the vent openings to a point above the bottom of the hull 17. The vent openings open generally downwardly to direct the air to the bottom of the hull 17 so that at least some of the water present in the air will drop out of the air to the bottom of the hull 17. Although not explicitly shown, a bilge pump could be provided in the bottom of the hull 17 for drainage.

The structure of the noise-reducing engine enclosure 11 for the personal watercraft 10 is best understood from FIGS. 1–5. The illustrated embodiment shows the noise-reducing engine enclosure 11 to reduce noise transmitted to the atmosphere or environment at least partially surrounding the noise-reducing engine enclosure 11 and the engine 14 used in the personal watercraft 10, for example. However, the noise-reducing engine enclosure 11 may be constructed and arranged to reduce noise transmission to the atmosphere external of the enclosure 11 and an engine used in any known vehicle, such as a snowmobile 100 shown in FIG. 7 or some other recreational vehicle.

Figure 2:
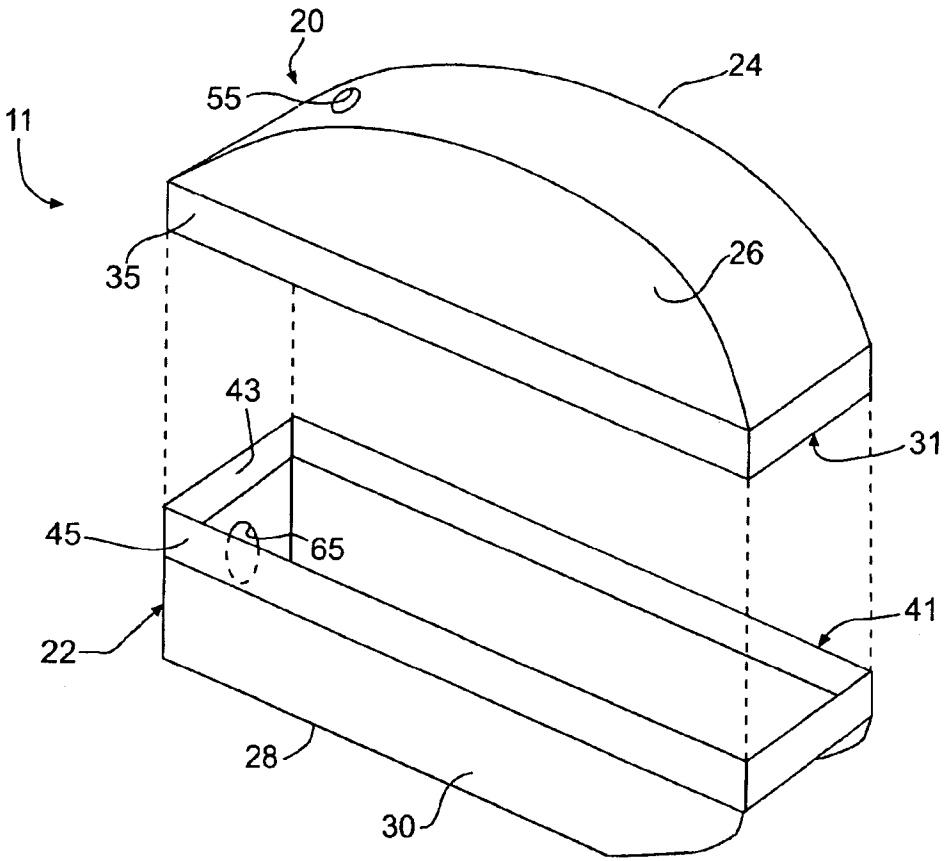
FIG. 2 is a perspective view of the noise-reducing engine enclosure shown in FIG. 1, illustrating the upper and lower portions separated from one another in an open or engine accessing position.
Figure 4:
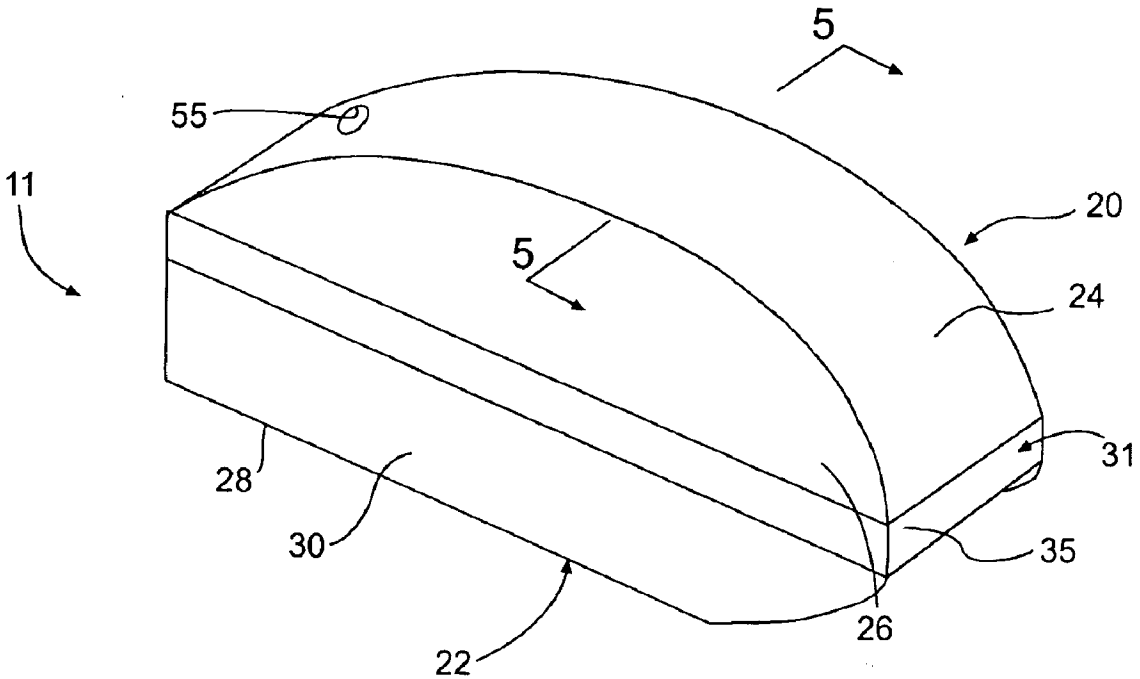
FIG. 4 is a perspective view of the noise-reducing engine enclosure shown in FIG. 3, illustrating the upper and lower portions in a closed or engine enclosing position where the upper portion cooperates with the lower portion of the noise-reducing engine enclosure to enclose the engine.
Figure 5A:
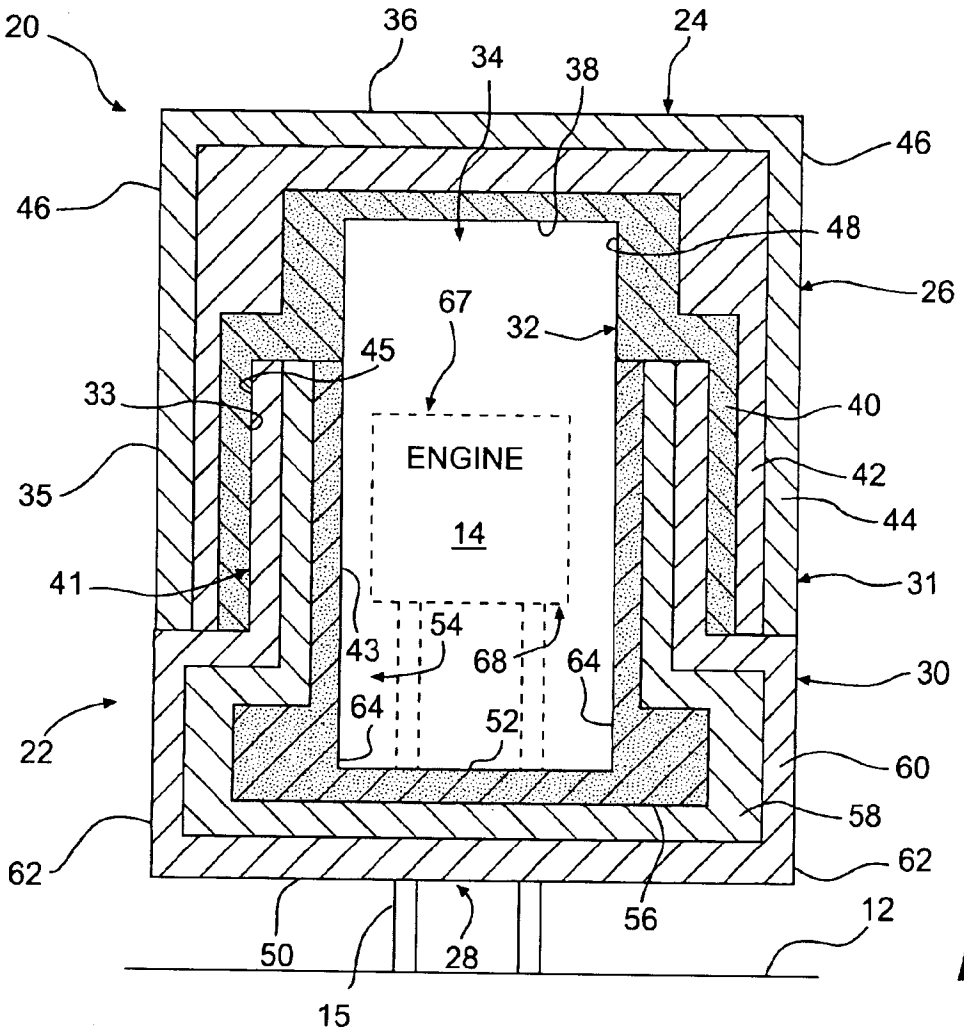
FIG. 5A is an enlarged cross-sectional view taken through line 5A—5A in FIG. 4.
Figure 6:
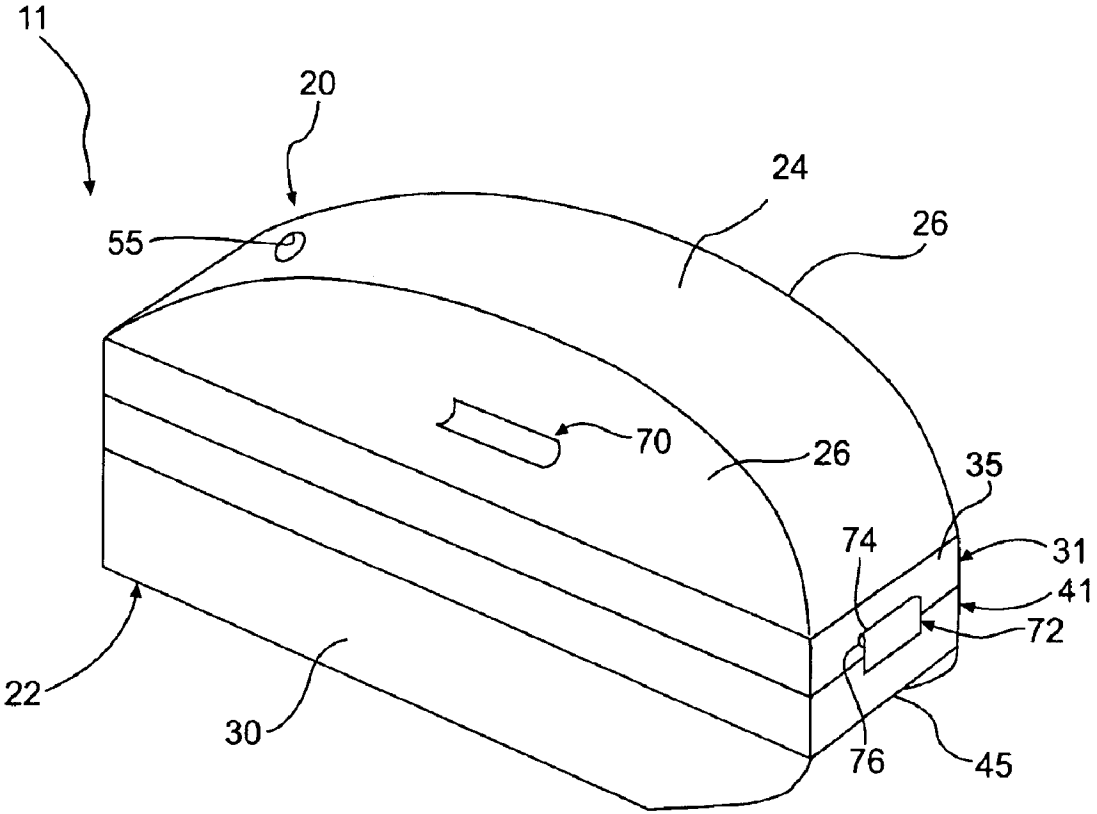
FIG. 6 is a perspective view of an alternative noise-reducing engine enclosure according to the principles of the present invention.

FIGS. 2–4 show the noise-reducing engine enclosure 11 comprising an upper portion 20 and a lower portion 22. The upper and lower portions 20, 22 are movable between an open position (FIGS. 2 and 3) and a noise-reducing, closed position (FIGS. 4, 5A and 6). In the open engine accessing position, the upper and lower portions 20, 22 are separated to allow access to the engine 14 or a portion thereof while the engine 14 remains within the lower portion 22. In the noise-reducing, closed position, the upper and lower portions 20, 22 enclose the engine 14 within an enclosed engine receiving space 34. Although the upper and lower portions 20, 22 are shown as separate elements, the upper and lower portions 20, 22 can be connected to one another, e.g., hingeably or slidably, to move between the open and closed positions thereof.

The upper portion 20 includes an upper wall 24, which is preferably arcuate, and a plurality of substantially vertical side walls 26 extending downwardly from the upper wall 24. The upper portion can conform to the shape of the vehicle seat or vehicle body. Alternatively, at least a portion of the vehicle seat or the vehicle body could form the upper portion 26. The lower portion 22 includes a lower wall 28 (FIG. 5A) and a plurality of substantially vertical side walls 30 extending upwardly from the lower wall 28. Preferably, the lower wall is curved.

The walls of the noise-reducing engine enclosure 11, for example, the upper and lower walls 24, 28 and side walls 26, 30 of the upper and lower portions 20, 22, respectively, preferably have a layered construction. The layered construction of each wall of the noise-reducing engine enclosure 11 includes a plurality of layers 32 (FIG. 5A), which are configured to reduce noise transmission to the atmosphere during operation thereof.

Referring to FIG. 5A, the upper wall 24 includes an upper outer surface 36, an upper engine-surrounding surface 38 and at least one layer therebetween, which as shown is a sound barrier layer 42. The side walls 26 similarly include an upper outer surface 46, an upper engine-surrounding surface 48 and at least one layer therebetween, which as shown is a sound barrier layer 42. The upper engine-surrounding surfaces 38, 48 cooperate to define an upper section of the engine receiving space 34. The plurality of layers 32 may comprise any number of layers, and especially may include more than one intermediate layer 42.

At least one noise insulated opening 55 is preferably formed in the side wall 30, but may be formed in other walls, including the arcuate upper wall 24 or the side walls 26 of the upper portion 20, to allow air or certain functional engine accessories or components, such as, for example, insulated air line conduits (not shown) or fuel line conduits, to pass therethrough. The opening 55 may be formed in any one of the walls 24, 26, in each of the walls 24, 26 or in any combination of walls 24, 26 that would provide convenient access to the engine 14. Each air line conduit could be constructed from a corrugated hose having foam inserted between each rib thereof to help reduce noise emanating from the at least one insulated opening 55 and transmitted to the atmosphere. Other ways to insulate the at least one opening 55 for noise or sound may be used, as would be understood by those skilled in the art. Suitable forms of insulation include an expansion chamber, a side branch resonator, a Helmoltz resonator, other passive elements, active systems (speakers, for example) or combinations thereof.

FIGS. 2–4 show one noise insulated opening 55 formed in the upper wall 24, which allows air to pass therethrough and into the engine 14. However, the noise insulated opening 55 or additional openings formed in the upper wall 24, for example, could also be configured to permit other functional components of the watercraft 10 to be attached thereto. The opening 55 may be insulated for noise by providing an airtight seal around the opening 55, for example, by using a grommet or any other airtight sealing structure.

The upper portion 20 further includes a mounting structure, which is in the form of a peripheral wall portion 31, extending along the lower periphery of the upper wall 24 and side walls 26. The peripheral wall portion 31 includes an interior surface 33 and an exterior surface 35 disposed opposite the interior surface 33 (FIG. 5A). The peripheral wall portion 31 may be formed integrally with the upper portion 20 and may also include a plurality of layers 32 extending between the interior and exterior surfaces 33, 35, with at least one layer 42 being shown in FIG. 5A. Alternatively, the mounting structure could be in the form of a flexible joint or a separate joining element between the upper and lower portions 20, 22, for example.

FIG. 5A shows the plurality of layers 32 including an absorbing layer 40, which defines the upper engine-surrounding surfaces 38, 48 and is configured to absorb noise in the engine receiving space 34, a sound barrier layer (or noise-reducing layer) 42, and a protective layer 44, which defines the upper outer surfaces 36, 46. The sound barrier layer 42 is configured to reduce noise transmission to the atmosphere from the engine receiving space 34. The protective layer 44 is configured to surround and protect the absorbing and sound barrier layers 40, 42. The layers may be combined or formed from a single material. The surfaces 36, 38, 46, 48 may be integral with their respective layers or may be a separate element attached to their respective layers.

A bilge pump may be provided in communication with the engine receiving space 34 to pump out or drain any excess water or moisture that penetrates this space 34. The bilge pump would be connected to the opening 55, for example, or any other suitable opening to pass water from the engine receiving space 34.

As illustrated in FIG. 5A, the upper side surface 46 is adjacent to the protective layer 44, which in turn abuts the sound barrier layer 42 on an exterior side thereof. The sound barrier layer 42, which may be constructed from a dense and heavy material or other suitable noise-reducing material, such as lead, BARYMAT™ or rubber, for example, is interposed between the protective layer 44 and the absorbing layer 40, which in turn may be positioned adjacent to the upper side engine engaging surface 48. The protective layer 44 may be constructed from a relatively rigid material, for example, fiberglass, plastic, metal or other suitably rigid material, and the absorbing layer 40 may be constructed from foam, such as an open cell foam, a closed cell foam, or another suitable absorbing material.

The absorbing layer 40, the sound barrier layer 42 and the protective layer 44 can be bonded to one another by adhesive or epoxy.

Although one arrangement of the layers 40, 42, 44 is illustrated in FIG. 5A, the layers 40, 42, 44 can be arranged in any order to provide noise-reducing characteristics to the noise-reducing engine enclosure 11. Moreover, a greater or smaller number of layers 32 may be incorporated into the design, as desired or as needed. Also, one or more of each layer 40, 42, 44 can be arranged in different orders. For example, one alternative arrangement could be to position the layers in the following order: the absorbing layer 40, the sound barrier 42, the absorbing layer 40 and the protective layer 44. Regardless of the specific design of the enclosure 11, the construction of materials and layered configuration, including thicknesses, must be taken into account so as to maintain the noise-reducing characteristics. If desired, the layers 32 can vary in number and thickness in different parts of the enclosure 11. For example, a thicker layer 32 could be used on the exhaust side of the engine 14 to enhance noise reduction.

The lower wall 28 and side walls 30 of the lower portion 22 also have a layered construction including surfaces that define a lower section of the engine receiving space 34. Similar to the upper wall 24 of the upper portion 20, the lower wall 28 comprises a series of layers 54, a lower outer surface 50 and adjacent layer 60, a lower engine surrounding surface 52 and adjacent layer 56, and at least one intermediate layer 58, extending therebetween. Preferably, the plurality of layers 54 has a substantially identical construction and operation to the plurality of layers 32 described above, as will be described in greater detail below. Again, the layers may be combined or formed from a single material and different thicknesses may be employed in various portions of the enclosure 11.

Each side wall 30 comprises lower side surfaces 62 and lower side engine surrounding surfaces 64, disposed opposite to the lower side surfaces 62. The plurality of the layers 54 extend between the lower side and lower side engine surrounding surfaces 62, 64, respectively, as layers 60, 58 and 56.

FIGS. 2 and 3 show a noise insulated opening 65 formed in one of the side walls 30 of the lower portion 22. The insulated opening 65 can allow certain functional components or engine accessories, such as, for example, the driveshaft 13, to pass therethrough (the driveshaft 13 is not shown in FIGS. 2 and 3). When functional components or engine accessories pass through the opening 65, the opening 65 may be insulated to minimize the emission of noise by providing an airtight seal around the opening 65, for example, by using a grommet or any other air tight sealing structure. Other ways to insulate the opening 65 for noise or sound also may be used as would be understood by those skilled in the art. Alternatively, at least one other noise insulated opening 65 could be provided in the lower portion 22 to allow air to pass therethrough for cooling purposes.

Alternatively, insulated and/or sealed openings could be provided for a heat exchanger, an air intake system, a fuel line, an oil filler neck, an electronic component, a bilge pump, or any other functional component external the enclosure 11 and/or operatively coupled to the engine 14.

A mounting structure, in the form of a peripheral wall portion 41, extends along the upper periphery of the lower and side walls 28, 30. The lower wall 28 preferably forms a portion of the hull. The side wall 30 preferably forms a portion of the hull, however such an arrangement is not necessary. The peripheral wall portion 41 includes an interior engine surrounding surface 43 and an exterior surface 45 located opposite the interior engine surrounding surface 43 (FIGS. 2 and 5A). The peripheral wall portion 41 may be formed integrally with the lower portion 22 and has the plurality of layers 54 extending between the interior and exterior surfaces 43, 45, as shown in FIG. 5A.

If desired, the enclosure 11 may be spaced from the hull with the engine supports 15 extending through the lower portion 22 to the hull 12.

The peripheral wall portions 31, 41 and the side walls 26, 28, 30 are preferably arcuate so as to form a generally annular configuration. Alternatively, the peripheral wall portions 31, 41 and the side walls 26, 28, 30 form a generally rectangular configuration, but may form other configurations as well.

FIG. 5A shows the plurality of layers 54 including an absorbing layer 56, which is configured to absorb noise in engine receiving space 34, a sound barrier layer (or noise-reducing layer) 58 and a protective layer 60. The sound barrier layer 58, which may be constructed from rubber or other suitable noise-reducing material, is interposed between the protective layer 60 and the absorbing layer 56, which may be positioned adjacent to the lower side engine surrounding surface 64. The protective layer 60 may be constructed from a relatively rigid material, for example, fiberglass, plastic, metal or other suitably rigid material, and the absorbing layer 56 may be constructed from foam, such as an open cell foam, or another suitable absorbing material. The lower outer surface 50 and lower side surfaces 62 may be integral with the layer 60 or attached thereto. The lower engine surrounding surface 52 and lower side engine surrounding surface 64 may be integral with the layer 56 or attached thereto.

Although one arrangement of the layers 56, 58, 60 is illustrated in FIG. 5A, the layers 56, 58, 60 can be arranged in any order or number to provide noise-reducing characteristics to the noise-reducing engine enclosure 11. Moreover, a greater number or fewer number of layers 54 may be incorporated into the design, as desired or needed. For example, one alternative arrangement could be as follows: the absorbing layer 56, the sound barrier 58, the absorbing layer 56 and the protective layer 60. Regardless of the specific design of the enclosure 11, the construction of materials and layered configuration, including the thickness, must be taken into account so as to maintain the noise-reducing characteristics.

Figure 5B:
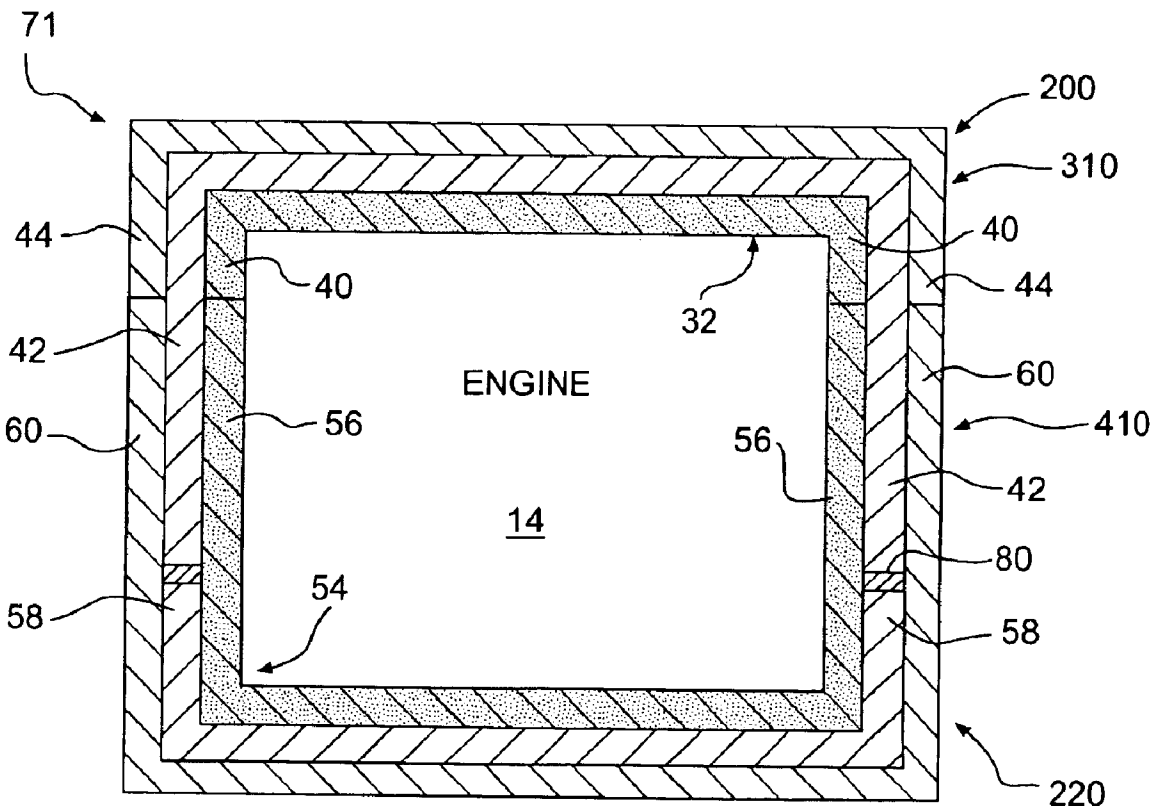
FIG. 5B is an enlarged cross-sectional view similar to FIG. 5A, but showing an alternative noise-reducing engine enclosure according to the principles of the present invention.

When the upper and lower portions 20, 22 are moved to the closed position (FIG. 4), the engine surrounding surfaces 38, 48, 52 and 64 of the noise-reducing engine enclosure 11 surround and substantially enclose the engine 14. When the upper and lower portions 20, 22 are moved into their closed positions, the upper and lower portions 20, 22 engage in cooperating relation to define the enclosed engine receiving space 34 therebetween to receive the engine 14. As shown in FIG. 5A, the interior surface 33 of the upper peripheral wall portion 31 engages the exterior surface 45 of the lower peripheral wall portion 41 when the upper and lower portions 20, 22 engage one another in cooperating relation. The peripheral wall 31 has an interior notch that mates with an exterior notch in peripheral wall 41. The engagement of the peripheral wall portions 31, 41 helps retain the upper and lower portions 20, 22 in cooperating relation by an interference fit or with gasketing 80 (i.e., with gaskets) as seen in FIG. 5B, for example. Additional padding or a decoupling device could be implemented between the peripheral wall portions 31, 41 to help reduce the effects caused by vibrations produced by the engine 14 during operation thereof. Also, these wall portions could be fastened to one another to help reduce the effects caused by vibrations produced by the engine 14 during operation thereof. It is not necessary to provide the lower wall 28 of the enclosure, which is preferably the hull, with absorbing material because vibrations and noise will be transferred to the water and hence dissipated.

It is preferred that the enclosure 11 not touch moving parts of the engine 14, such as the drive shaft, or any other part of the vehicle that could cause rattling to occur.

In the noise-reducing position or closed position shown in FIG. 5, the upper and upper side engine surrounding surfaces 38, 48 of the upper portion 20 surround an upper segment 67 of the engine 14 in surrounding relation. The lower and lower side engine surrounding surfaces 52, 64 of the lower portion 22 surround a lower segment 68 of the engine 14 in surrounding relation. The upper and upper side engine surrounding surfaces 38, 48 and the lower and lower side engine surrounding surfaces 52, 64 are sufficiently spaced from the engine 14 so that air can circulate around the engine to allow proper cooling of the engine 14. The engine 14 can be mounted within the enclosure 11 using any known mounting means.

FIG. 5B is similar to FIG. 5A, but shows a noise-reducing engine enclosure 71 that is an alternative configuration of the noise-reducing engine enclosure 11. The noise-reducing engine enclosure 71 is of substantially the same construction and operation as the noise-reducing engine enclosure 11, but the arrangement of the plurality of layers 32, 54 and the interlocking peripheral wall portions 310 and 410 are different. As illustrated in FIG. 5B, the plurality of layers 32 is arranged to form an overlapping relationship with the plurality of layers 54. This arrangement is similar to a tongue and groove relationship. By this, the upper portion 200 and the lower portion 220 interlock with the outer layers 44 and 60 and the inner layers 40 and 56 directly abutting while the intermediate layer 42 extends into the lower portion 220 to abut recessed intermediate layer 58. Also, the plurality of layers 32, 54 abut the engine 14. As with the construction of FIG. 5A, the construction of FIG. 5B allows the first member (the upper portion) 200 to form at least a portion of the seat when used in a watercraft, or a portion of the hood when used in a snowmobile. Similarly, the lower portion 220 can form a bottom portion of the hull or frame.

The upper and lower portions 20, 22 (200, 220) are each preferably molded of a plastic or other relatively rigid material as single structures. As shown in FIG. 6, handles 70 may be formed in or integrated with the upper and lower portions 20, 22 (200,220). The handles 70 may be manually engaged or grasped by the user to help him/her separate the upper and lower portions 20, 22 from one another to access the engine 14. The handles 70 could be formed in the side walls 26 of the upper portion 20, for example.

Fasteners, one of which is shown FIG. 6 in the form of a latching member 72, may be used to hold the upper and lower portions 20, 22 (200, 220) together in the engine enclosing position. Latching members 72 are commonly known in the art and generally include a latching portion 74 which is configured to releasably fasten to a latch-receiving portion 76. The latching member 72, for example, could be pivotally mounted on the upwardly extending peripheral wall portion 41 of the lower portion 22 and the latch-receiving portion 76 could be mounted on the peripheral wall portion 31 of the upper portion 20. The latching member 72 is positioned with respect to the latch receiving portion 76 such that the latching portion 74 can be moved into engagement and retained by the latch-receiving portion 76 when the upper and lower portions 20, 22 are moved into their closed, engine enclosing position. When the latching portion 74 is received and retained in the latch-receiving portion 76, the upper and lower portions 20, 22 are retained in their closed, engine enclosing position.

Alternatively, the latching member 72 could be integrally formed with one of the peripheral wall portions 31, 41 so that the latching portion 74 and the latch-receiving portion 76 could be configured to have a snap-fit arrangement. For example, the latching member 72 could be configured to deflect away from and then snap onto the latch-receiving portion 76 when the upper and lower portions 20, 22 are brought into engagement with one another. The latching member 72 could be similarly implemented on the enclosure 71 of FIG. 5B.

In another embodiment not shown, it is contemplated that the upper and lower portions 20, 22 may be hinged together at one common edge thereof. This would enable the noise-reducing engine enclosure 11 to be simply pivoted between open and closed positions.

The operation of the noise-reducing engine enclosure 11 will be described below. If a user wants to access the engine 14, the upper portion 20 can be moved into the open position to provide a user access to at least a part of the engine 14. The user could, for example, grasp the handles 70 to effect separation of the upper and lower members 20, 22 if they cooperatively engage one another by an interference fit, as shown in FIG. 5A. Alternative ways to move the upper and lower members 20, 22 into their respective positions to facilitate access to the engine 14 can be used, for example, by pivoting the upper portion 20 relative to the lower member 22, if they are hinged together at a common edge thereof.

When a user moves the upper and lower portions 20, 22 into the engine enclosing position, the plurality of layers 32, 54, including the sound barrier layers 42, 58, reduce noise transmission to atmosphere enclosure 11 during operation of the engine. Operation of the enclosure 71 would occur in a similar manner to those described above.

In some instances, certain engine accessories, such as the driveshaft 13, may need to pass through the noise-reducing engine enclosure. Therefore, as indicated in the embodiment shown in FIGS. 8–9, the noise-reducing engine enclosure 111 can be provided with insulated openings to allow certain functional components to pass therethrough, such as the driveshaft 13, a cooling hose or an insulated air intake hose. The noise-reducing engine enclosure 111 is an alternative configuration of the noise-reducing engine enclosure 11 shown in FIGS. 1–7 and can be positioned within any suitable vehicle, for example, a personal watercraft 10 or a snowmobile 100.

Figure 8:
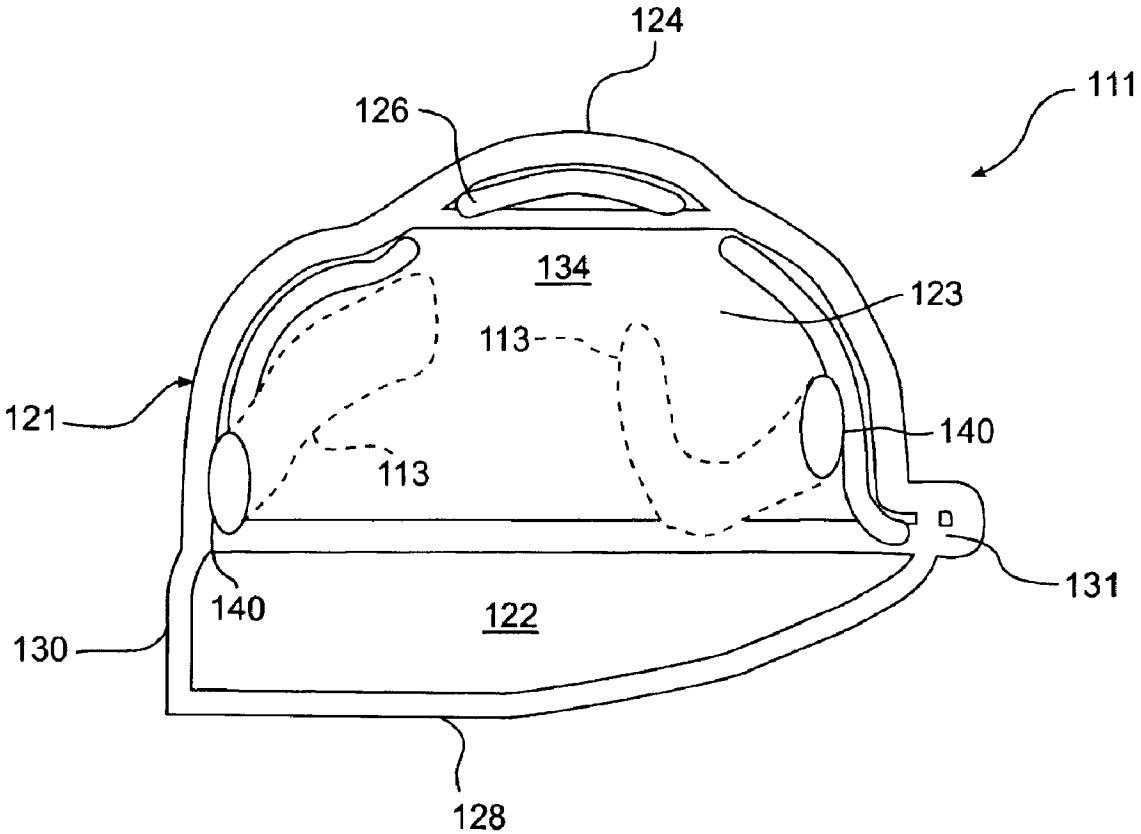
FIG. 8 is an enlarged side view of the noise-reducing engine enclosure shown in FIG. 7, showing the noise-reducing engine enclosure in greater detail.
Figure 9:
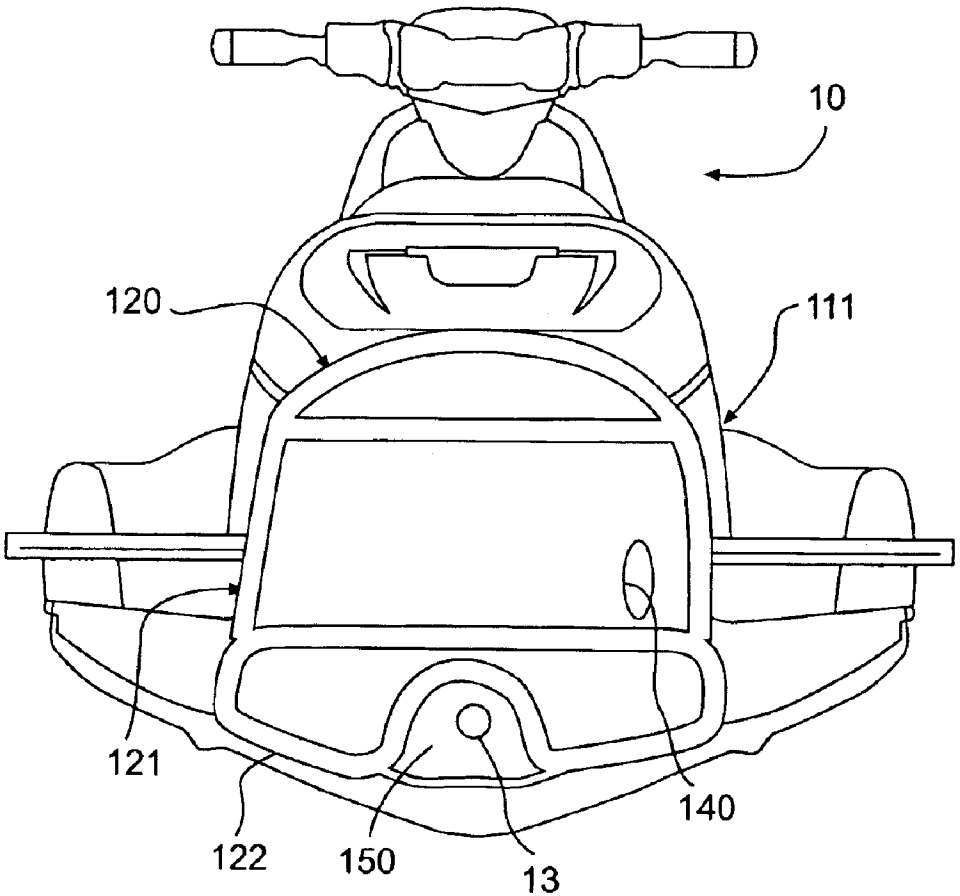
FIG. 9 is a rear view of the noise-reducing engine enclosure shown in FIG. 8, showing the noise-reducing engine enclosure releasably mounted within a vehicle, e.g., a personal watercraft.

As shown in FIGS. 8 and 9, the noise-reducing engine enclosure 111 comprises an upper lid member 120, a lower member 122, and an intermediate member 121. The lower member 122 is configured to carry and surround at least a lower portion of the engine 14 and may be fixedly disposed within a cavity formed by a vehicle, in this case the deck 12 and the hull 17. For example, the lower member 122 of the noise-reducing engine enclosure 111 may tightly abut the interior surfaces of the hull cavity or may be coupled to the hull 17 with fasteners, such as screws, nuts and bolts, or clamps. The lower member 122 may be constructed to be substantially complimentary to the configuration of the cavity formed by the hull 17 and the deck 12. The intermediate member 121 could be spaced from the side panel of the hull or could tightly abut the same.

The intermediate member 121 removably couples to the lower member 122, for example, by an interference fit, a snap fit or fasteners such as, for example, quarter-turn screws or other suitable fasteners, to surround an intermediate portion of the engine 14. The upper lid member 120 removably couples to the intermediate member 121, for example, by an interference fit, a snap fit or fasteners such as, for example, spring-loaded quarter-turn screws or other suitable fasteners, to surround an upper portion of the engine 14.

The upper lid member 120 and the intermediate member 121 are movable between an engine accessing position and an engine enclosing position. The upper lid member 120 could be part of the seat when used in a watercraft, or part of the hood when used in a snowmobile, for example. In the engine accessing position, either the intermediate member 121, the upper lid member 120 or both can be positioned to allow access to the engine 14 or at least a part of the engine 14. For example, the upper lid member 120 can be removed from the intermediate member 121 so that a user can access a portion of the engine 14 or the upper lid and intermediate members 120, 122 can be removed together from the lower member 122 so that a user can more fully access the engine 14. In the engine enclosing position shown in FIGS. 8 and 9, the upper lid member 120, the intermediate member 121 and the lower member 122 cooperate to define an engine receiving space 134 configured to receive and enclose the engine 14 therein. The engine receiving space 134 is substantially identical in function to the engine receiving space 34 shown in FIG. 5A.

Figure 10:
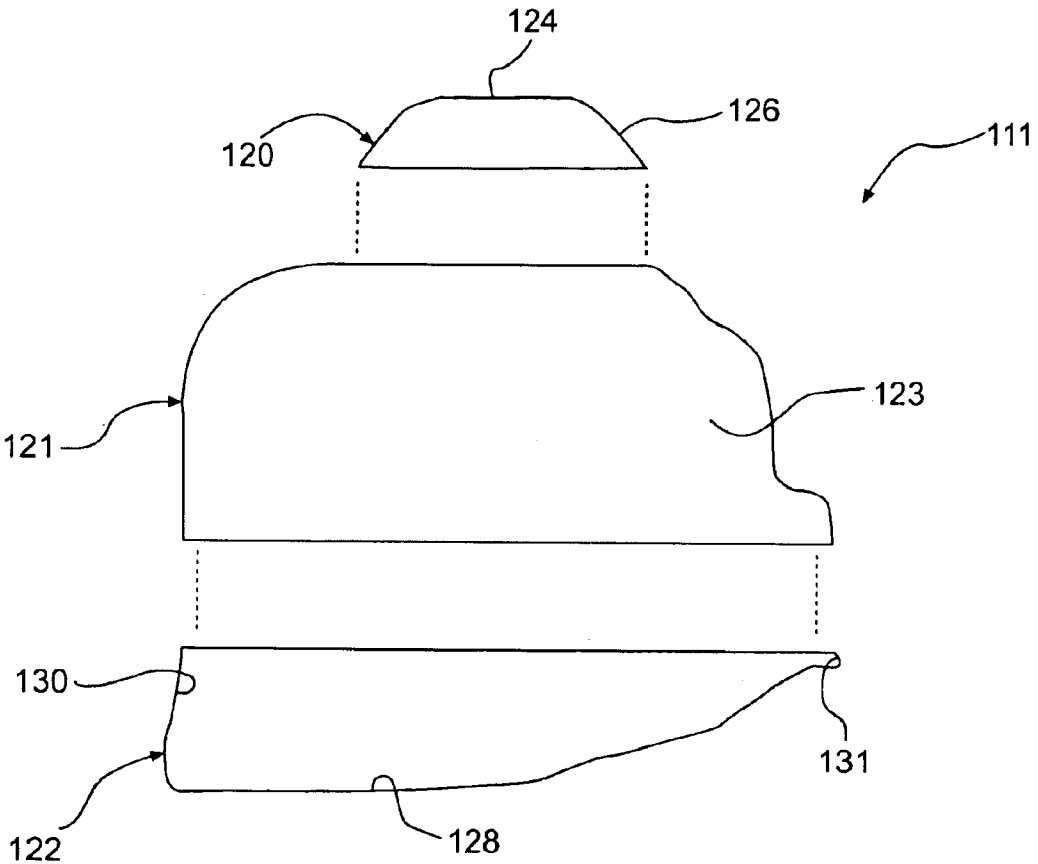
FIG. 10 is a side view of the noise-reducing engine enclosure shown in FIG. 8, showing the upper, intermediate and lower members of the noise-reducing engine enclosure separated from one another.

As best shown in FIG. 10, the upper lid member 120 includes an arcuate upper wall 124 and a plurality of inclined side walls 126 extending downwardly from the upper wall 124. The upper lid member 120 may be any size, but preferably is sized to allow easy access to the engine 14, for example, to check the oil of the engine 14.

The lower member 122 includes a generally curved lower wall 128 and a plurality of substantially vertical side walls 130, 131 extending upwardly from the lower wall 128. Although the lower member 122 houses the engine 14 primarily, the lower member 122 may be constructed to house other engine components or accessories as well, such as the driveshaft 13. For example, FIG. 9 shows the lower member 122 having a noise insulated opening 150 formed therein, as will be discussed in greater detail below.

The intermediate member 121 includes a pair of substantially flat, vertically extending side walls 123, which extend between the side walls 126 of the upper lid member and the side walls 130, 131 of the lower member 122.

FIGS. 8 and 9 best show noise insulated openings 140 formed in the side walls 123 of the intermediate member 121 to allow certain engine accessories, such as insulated air intake hoses 113, for example, to pass therethrough. The air intake hoses 113 may extend between the openings 140 and the air intake 16 of the engine 14, for example, to allow air to pass therethrough and into the engine 14. A tube and a hose, or both, can be positioned in communication one of the insulated openings 140. For example, at least one of the tube and the hose can be molded with the enclosure and an interior of the tube or the hose can be insulated for noise. Also, the tube and the hose can be arranged so that the tube is flush with the inside of the enclosure or completely external to the enclosure. Any number of insulated openings 140 may be used. It is preferred, however, that air intake hoses 113 not be connected directly to the engine 14 so as to use the enclosure as an air box.

The openings 140 may be insulated for noise by providing an airtight seal around the opening 140, for example, by using a grommet or any other air tight sealing structure. In FIG. 8, the air intake hoses 113 are constructed from a corrugated hose having foam inserted between each rib to help reduce noise emanating from the noise insulated openings 140. Other ways to insulate the openings 140 and the air intake hoses 113 for noise or sound may be used as would be appreciated by those skilled in the art.

Alternatively, insulated openings 140 may be provided in the noise-reducing engine enclosure 111 for other functional components (external to the enclosure 111) to be operatively coupled to the engine 14. The functional components may include, but should not be limited to, a fuel line carrying fuel to the engine 14, a heat exchanger configured to help cool the engine, an electrical component configured to provide an electrical function, such as sparking of spark plugs housed in the engine 14, and an exhaust for exhausting exhaust gases from the engine. The insulated openings 140 for these functional components may be provided in any of the side walls 123 of the intermediate member 121, the side walls 126 of the upper lid member 120 or the side walls 130, 131 of the lower member 122. Hoses could be provided on the lower member 122 so that any hoses connected to the upper portion 120 or the intermediate portion 121 would not have to be disconnected prior to removal of those portions.

The walls of the noise-reducing engine enclosure 111, for example, the upper and lower walls 124, 128 and side walls 126, 130 of the upper and lower members 120, 122, respectively, and the side walls 123 of the intermediate member 121 have a layered construction. The layered construction of each wall of the noise-reducing engine enclosure 111 includes a plurality of layers configured to reduce noise transmission to the atmosphere from the engine 14 during operation thereof. Since the plurality of layers in the walls of the noise-reducing engine enclosure 111 have substantially identical structure and operation as the plurality of layers 32, 54 of the noise-reducing engine enclosure 11, the descriptions set forth above with respect to the plurality of layers 32, 54 is sufficient for both. Either of the pluralities of layers 32, 54 can be used in the noise-reducing enclosure 111.

FIG. 9 shows an insulated groove 150, which may be formed in the lower member 122 of the noise-reducing engine enclosure 111 to receive the driveshaft 13 therethrough. The insulated groove 150 may be insulated for noise by providing an airtight seal around the groove 150, for example, by using a grommet or any other air tight sealing structure. The groove 150 is configured to substantially surround the driveshaft 13, as shown in FIG. 9, such that the drive shaft 13 rotates the propelling structure along with the crankshaft, as described above.

The noise-reducing engine enclosures 11, 111 are of similar construction and have similar operations. Since the upper and intermediate members 120, 121 can be removed from the lower member 122, either together or separately, the noise-reducing engine enclosure 111 is quite versatile and can provide a wide range of applications.

For example, if a user wants to access the engine 14 for major repair work, he/she may remove the intermediate and upper lid members 121, 120 of the noise-reducing engine enclosure to access the necessary part(s) of the engine 14. However, if the user only wants to check the oil of the vehicle 10, for example, he/she may only need to remove the upper lid member 120 to access the necessary part(s) of the engine 14.

While the invention has been described with reference to certain illustrated embodiments, including particular structures, acts and materials, the invention is not to be limited to the particulars disclosed, but rather extends to all equivalent structures, acts, and materials, such are within the scope of the appended claims.

Since numerous modifications and changes to the embodiments described above will readily occur to those of ordinary skill in the art, it is not desired to limit the invention to the exact construction and operation illustrated and described. Accordingly, all suitable modifications and equivalents should be considered as falling within the spirit and scope of the invention.

What is claimed is:

1. A noise-reducing engine enclosure for surrounding an engine, comprising:

a first member; and a second member, the first member and the second member being positioned in cooperating relation with respect to each other to define an engine receiving space between said first and second members, said engine receiving space being configured to receive and enclose the engine therein, said first and second members each including a noise-reducing layer of material constructed and arranged to reduce noise transmission to an atmosphere external of said engine receiving space during operation of the engine, and said first member being movable with respect to said second member between (1) an engine accessing position, wherein said first and second members are positioned to allow access to the engine and (2) an engine enclosing position, wherein said first and second members enclose the engine therein such that transmission of noise from said engine receiving space during operation of the engine is reduced.

2. A noise-reducing engine enclosure as defined in claim 1, wherein at least one of said first and second members defines at least one opening, the at least one opening being configured to at least one of allow air to be communicated to the engine and enable functional components external to the enclosure to be operatively connected to the engine.

3. A noise-reducing engine enclosure as defined in claim 1, wherein said noise-reducing layer of material comprises a plurality of layers constructed and arranged to reduce noise transmission to the atmosphere external of said engine receiving space.

4. A noise-reducing engine enclosure as defined in claim 3, wherein said plurality of layers includes an absorbing layer configured to absorb noise, a sound barrier layer configured to reduce noise transmission to the atmosphere external of said engine receiving space and a protective layer configured to surround said absorbing layer and said sound barrier layer.

5. A noise-reducing engine enclosure as defined in claim 4, wherein said absorbing layer includes foam.

6. A noise-reducing engine enclosure as defined in claim 5, wherein said foam is an open cell foam.

7. A noise-reducing engine enclosure as defined in claim 5, wherein said sound barrier layer includes rubber.

8. A noise-reducing engine enclosure as defined in claim 4, wherein said sound barrier layer includes rubber.

9. A noise-reducing engine enclosure as defined in claim 4, wherein said protective layer includes at least one of fiberglass, plastic and metal.

10. A noise-reducing engine enclosure as defined in claim 4, wherein said sound barrier layer is positioned between said protective layer and said absorbing layer, and wherein said absorbing layer, said protective layer, and said sound barrier layer are bonded together.

11. A noise-reducing engine enclosure as defined in claim 1, wherein said first and second members are releasably secured to one another.

12. A noise-reducing engine enclosure as defined in claim 1, wherein said first member is removable with respect to said second member.

13. A noise-reducing engine enclosure as defined in claim 10, wherein said first and second members are removably mounted to one another by a releasable fastener, said releasable fastener being movable between a released position, wherein said first and second members are permitted to move into said engine accessing position, and a fastened position, wherein said first and second members are releasably secured in said engine enclosing position.

14. A noise-reducing engine enclosure as defined in claim 1, wherein said first and second members each have a mounting structure, wherein said mounting structure of said first member engages said mounting structure of said second member such that said first and second members are releasably mounted to one another by an interference fit between said mounting structures.

15. A noise-reducing engine enclosure as defined in claim 14, wherein said first and second members are each formed of a plurality of layers, and wherein the mounting structure of the first and second members includes interlocking layers.

16. A noise-reducing engine enclosure as defined in claim 1, wherein said first member includes a lid portion and an intermediate portion, wherein the lid portion is separable from the intermediate portion.

17. A noise-reducing engine enclosure as defined in claim 16, wherein said lid member includes an upper wall and a plurality of side walls, said intermediate member includes a plurality of side walls, and said second member includes a lower wall and a plurality of side walls.

18. A noise-reducing engine enclosure as defined in claim 17, wherein said upper and side walls of said lid member, said side walls of said intermediate member and said lower wall and side walls of said second member have surfaces that define said engine receiving space.

19. A noise-reducing engine enclosure as defined in claim 2, wherein said at least one opening is insulated to reduce noise transmission to the atmosphere external of said engine receiving space.

20. A noise-reducing engine enclosure as defined in claim 2, further comprising a hose extending from said at least one opening.

21. A noise-reducing engine enclosure as defined in claim 1, in combination with an engine, wherein said second member includes a lower wall and side walls that are configured to engage and carry a lower portion of said engine.

22. A noise-reducing engine enclosure as defined in claim 1, wherein said first and second members each include an inner foam layer, an outer fiberglass layer and an intermediate rubber layer positioned between said inner foam layer and said outer fiberglass layer to a form the noise-reducing layer of material.

23. A noise-reducing engine enclosure as defined in claim 1, in combination with a personal watercraft having an engine, wherein the engine is retained within the engine enclosure.

24. A noise-reducing engine enclosure as defined in claim 1, in combination with a snowmobile having an engine, wherein the engine is retained within the engine enclosure.

25. A noise-reducing engine enclosure as defined in claim 1, further comprising a gasket disposed between said first member and said second member in the engine enclosing position.

26. A noise-reducing enclosure for surrounding an engine to reduce noise transmission from the engine to an atmosphere external of the noise-reducing enclosure, comprising:

a first member having a first engine surrounding wall; and a second member having a second engine surrounding wall, said first and second engine surrounding walls each including a noise-reducing layer of material and being engageable in cooperating relation with one another to define an engine receiving space therebetween in which noise transmission to the atmosphere from an engine retained within the enclosure during operation is reduced by said noise-reducing layer of material, said first and second members providing at least one opening, said engine-surrounding wall of said first member engaging a first portion of said engine and said engine-surrounding wall of said second member engaging a second portion of said engine.

27. A noise-reducing engine enclosure as defined in claim 26, wherein the at least one opening is configured either to allow air to be communicated to the engine receiving space or to enable functional components external to the enclosure to be operatively connected to the engine.

28. A noise-reducing engine enclosure as defined in claim 26 in combination with an engine, wherein the engine surrounding wall of said first member is spaced from a first portion of said engine and said engine surrounding wall of said second member is spaced from a second portion of said engine.

29. A noise-reducing engine enclosure as defined in claim 26, wherein said noise-reducing layer of material comprises a plurality of layers.

30. A noise-reducing engine enclosure as defined in claim 29, wherein said plurality of layers includes at least an absorbing layer configured to absorb noise, a sound barrier layer configured to reduce noise transmission to the atmosphere surrounding the engine and a protective layer configured to surround said absorbing layer and said sound barrier layer.

31. A noise-reducing engine enclosure as defined in claim 30, wherein said absorbing layer includes foam.

32. A noise-reducing engine enclosure as defined in claim 31, wherein the foam is an open cell foam.

33. A noise-reducing engine enclosure as defined in claim 30, wherein said sound barrier layer includes rubber.

34. A noise-reducing engine enclosure as defined in claim 30, wherein said protective layer includes at least one of fiberglass, plastic and metal.

35. A noise-reducing engine enclosure as defined in claim 30, wherein said sound barrier layer is positioned between said protective layer and said absorbing layer and wherein said protective layer, said absorbing layer and said sound barrier layer are bonded together.

36. A noise-reducing engine enclosure as defined in claim 26, in combination with an engine positioned in a vehicle, and wherein at least one of the first member and the second member comprises a portion of the vehicle.

37. A noise-reducing engine enclosure as defined in claim 36, wherein the vehicle is a personal watercraft having a hull and a seat, and wherein at least one of a portion of the seat forms the first member and the a portion of the hull forms the second member.

38. A noise-reducing engine enclosure as defined in claim 36, wherein the vehicle is a snowmobile, and wherein the first member constitutes at least a portion of a hood of the snowmobile.

39. A personal watercraft, comprising:

a hull;

an engine that generates power supported by the hull;

a propulsion system connected to said engine, wherein said propulsion system propels said watercraft along a surface of a body of water using power generated by said engine; and a noise-reducing engine enclosure supported by the hull and surrounding the engine, wherein said noise-reducing engine enclosure comprises:

a first member having a first engine surrounding wall; and a second member having a second engine surrounding wall, said first and second engine surrounding walls each including a noise-reducing layer of material and being engageable in cooperating relation with one another to define an engine receiving space therebetween in which noise transmission to the atmosphere from an engine retained within the enclosure during operation is reduced by said noise-reducing layer of material, said first and second members providing at least one opening.

40. A personal watercraft as defined in claim 39, wherein said engine is an internal combustion engine with a driveshaft and wherein the personal watercraft further comprises:

a fuel supply, said engine being in communication with said fuel supply by a fuel supply line; and an air intake for supplying air to said engine, wherein said at least one opening includes an opening in communication with said air intake, an opening that receives the fuel supply line and an opening that receives the driveshaft.

41. A personal watercraft as defined in claim 39, wherein said second member defines a propulsion system opening therethrough, and wherein said propulsion system includes a driveshaft, and said propulsion system opening surrounding a portion of said driveshaft.

42. A personal watercraft as defined in claim 39, wherein said second member has a shape that substantially compliments said hull.

43. A personal watercraft as defined in claim 39, wherein at least one of said first and second members forms part of at least one of a seat and the hull.

44. A personal watercraft as defined in claim 39, further comprising a straddle seat supported by the hull and jet pump operatively connected to the engine.

45. A personal watercraft comprising:

a hull;

an engine that generates power supported by the hull;

a propulsion system connected to said engine, wherein said propulsion system propels said watercraft along a surface of a body of water using power generated by said engine; and a noise-reducing engine enclosure supported by the hull and surrounding the engine, wherein said noise-reducing engine enclosure comprises:

a first member having a first engine surrounding wall; and a second member having a second engine surrounding wall, said first and second engine surrounding walls each including a noise-reducing layer of material and being engageable in cooperating relation with one another to define an engine receiving space therebetween in which noise transmission to the atmosphere from an engine retained within the enclosure during operation is reduced by said noise-reducing layer of material, said first and second members providing at least one opening.

said first and second members each including a noise-reducing layer of material constructed and arranged to reduce noise transmission to an atmosphere external of said engine receiving space during operation of the engine, and said first member being movable with respect to said second member between (1) an engine accessing position, wherein said first and second members are positioned to allow access to the engine and (2) an engine enclosing position, wherein said first and second members enclose the engine therein such that transmission of noise from said engine receiving space during operation of the engine is reduced.

46. A personal watercraft as defined in claim 45, further comprising a straddle seat supported by the hull and jet pump operatively connected to the engine.

* * * * *